US006772444B2

(12) United States Patent
Tremblay-Lutter

(10) Patent No.: US 6,772,444 B2
(45) Date of Patent: Aug. 10, 2004

(54) COMFORT LINERS FOR CHEMICAL PROTECTIVE AND OTHER IMPERMEABLE POLYMER GLOVES

(75) Inventor: Julie Tremblay-Lutter, Stittsville (CA)

(73) Assignee: The Minister of National Defence of Her Majesty's Canadian Government, Ottawa (CA)

( * ) Notice: Subject to any disclaimer, the term of this patent is extended or adjusted under 35 U.S.C. 154(b) by 60 days.

(21) Appl. No.: 10/140,258

(22) Filed: May 8, 2002

(65) Prior Publication Data

US 2003/0066120 A1 Apr. 10, 2003

Related U.S. Application Data

(60) Provisional application No. 60/289,136, filed on May 8, 2001.

(51) Int. Cl.[7] ..... A41D 19/00
(52) U.S. Cl. ..... 2/164
(58) Field of Search ..... 2/161.1, 161.6, 2/167, 164, 169; 57/243, 244, 255; 66/45, 174

(56) References Cited

U.S. PATENT DOCUMENTS 5,113,532 A * 5/1992 Sutton ..... 2/167
5,740,551 A 4/1998 Walker
5,799,333 A * 9/1998 McGarry et al. ..... 2/161.6
6,367,290 B2 * 4/2002 Kolmes et al. ..... 66/172 R

FOREIGN PATENT DOCUMENTS

| | | |
|---|---|---|
| DE | 196 24 245 C1 | 10/1997 |
| EP | 0 711 514 A1 | 5/1996 |
| WO | WO 00/53039 A1 | 9/2000 |
| WO | WO 00/67600 A1 | 11/2000 |

OTHER PUBLICATIONS

James S. Johnson and S.Z. Mansdorf, Eds., "Evaluation of Candidate Glove Liners for Reduction of Skin Maceration in Chemical Protective Gloves," pp. 296–310, American Society for Testing and Material (1996).
James S. Johnson and S.Z. Mansdorf, Eds., "Functional Fit Evaluation to Determine Optimal Ease Requirements in Chemical Protective Gloves", pp. 367–383, American Society for Testing and Material, (1996).

* cited by examiner

*Primary Examiner*—Katherine Moran
(74) *Attorney, Agent, or Firm*—Rader, Fishman & Grauer PLLC

(57) ABSTRACT

A combination of fiber materials for use as liner for chemical protective gloves is disclosed. The material consists of viscose, polyester and acrylic yarns knitted together either by plating or speckling. Glove liners made of these materials have higher moisture absorbency, faster drying time, improved functional fit and enhance hand dexterity. Depending on the application this invention can be used in combination with other types of gloves or independently.

5 Claims, No Drawings

COMFORT LINERS FOR CHEMICAL PROTECTIVE AND OTHER IMPERMEABLE POLYMER GLOVES

This application claims the benefit of Provisional Application No. 60/289,136 filed May 8, 2001.

FIELD OF THE INVENTION

The present invention relates to glove liners designed for protection from chemical toxic agents utilizing combination of liner materials to improve moisture management, hand dexterity and functional fit.

BACKGROUND OF THE INVENTION

Chemical protective gloves are required for protection from toxic agents in liquid and vapour forms. Depending on specific threat environments, gloves can be worn for extended periods of time anywhere between 24–48 hours. Gloves that are impermeable to chemical agents and water vapour may cause considerable discomfort and loss of manual dexterity. Reductions in manual dexterity can result from numbness, tingling, stiffening or swelling in the fingers and knuckles. The skin of the hands may become saturated with moisture causing the outer layer of the skin to swell and soften. In severe cases permanent damage to the hands can result due to maceration of the skin.

Commercially available glove liners used in chemical protective glove are typically string knit using knitting machines with various knitting gauge options, for different yarn sizes. Liners were available in cotton, nylon, polyester or wool. Sewn liners such as nylon inspector's gloves or cotton photographer's gloves are also available and are constructed using conventional sewing techniques. The sewn gloves inspected were only available in limited number of smaller sizes and were poorly constructed. A significant problem with sewn gloves is the increase in bulk around the fingers and hands caused by excess seam allowances. Commercial gloves were available only in a limited selection of fiber content that were not very effective with respect to moisture absorbency. The design of the glove liners was also bulky and poor fitting that would eventually cause hand malaise and degradation in hand dexterity if worn with a polymer protective glove.

While there have been discoveries on improved materials and methods of manufacturing glove and glove liners (see, for example, U.S. Pat. Nos. 4,947,486, 5,123,119 and 5,568,656), there has been no comprehensive study being conducted on suitable materials for glove liners for use in chemical protective gloves. Accordingly, there remains a need for better materials and means of manufacturing glove liners for this type of specialized gloves.

In an earlier study, the inventor of the present invention evaluated various types of glove liner materials (see Trembaly-Lutter, J. F., Lang, J. Q., Pichette, D AEvaluation of Candidate Glove Liners for Reduction pf Skin Maceration in Chemical Protective Gloves @Performance of Protective Clothing: Fifth Volume, ASTM STP1237, James S. Johnson and S. Z. Mansdorf, Eds., American Society for Testing and Materials, 1996. Pp 296–310). It was found that viscose fibers offered the absorbency properties and polymester fibers demonstrated faster dying times. While incorporating LYCRA (trademark) yarns into the glove design did not change the absorbency properties, and yet it reduced the drying time and improved the functional fit of the glove.

In view of this general knowledge, it is highly desirable to examine the various effects of yarn density, yarn count and fabric structure of these materials in order to come up with the best liners for chemical protective gloves.

SUMMARY OF THE INVENTION

The present inventor examined more than seventy types of glove liners with a view to develop the best material specification to be used in chemical protective gloves. Using a specific fiber content, yarn tex and fiber structure, the glove liner according to the present invention is able to manage sweat accumulation inside impermeable gloves while minimizing interference with manual dexterity.

An object of the present invention is to develop a new glove liner which absorbs sweat and keeps the hand dry. Another object of the present invention is to provide a liner which is thin enough not to interfere with hand manipulation. A further object of the present invention is to produce a glove liner that offers functional fit to a wide population of users.

These and other objects, advantages and features of the invention shall be described below.

DETAILED DESCRIPTION OF A PREFERRED EMBODIMENT

One major deficiency identified in chemical protective gloves is the sweat build-up inside of the gloves causing discomfort and limited time of wear. The present invention studies the physical properties of liner materials that minimize the sweat build-up in the gloves and evaluates candidate glove liners to optimize any combination of fibers and structures that will effectively improve the wearer's comfort.

A test protocol was developed to evaluate the key properties of liners. Sixteen prototype glove liners with various combinations of cotton, viscose and polyester microfibers and two knit structures were examined. Properties such as moisture regain, wicking, water absorption and drying time were deemed essential for glove liners and were thus evaluated. Mass, yarn density, fabric count, thickness and knitting structure were also evaluated to determine their relative effect on these essential properties.

Procedures and Test Methods

Based on the review of specifications and literature related to glove and liner materials, the following tests were selected to evaluate the performance of liner materials: mass, thickness, fabric count, yarn twist, moisture regain, dynamic water absorption, vertical wicking and drying time. A laboratory evaluation protocol was developed and summarised in Table 1.

Mass

The mass of glove liner was determined by averaging the mass of 5 die-cut circular specimens (5.15 cm in diameter) and the mass in grams per square meter was reported. The specimens were conditioned overnight at standard atmosphere prior to the weighing process.

Thickness

The thickness of glove liner was measured both on single layer and double layer at a pressure of 1.03 kPa. For each prototype liner, five gloves were measured and the average was reported. The numbers of wales and courses per five centimeters were counted for five gloves of each prototype liner. The averages of the five counts were reported as wales and courses per centimeter.

Yarn Twist

To determine yarn twist, a yarn was removed from the glove liner and, while under tension, was secured between two clamps which were at a known distance apart (depends on yarn structure). One of the clamps was then rotated until all twists were removed from the length of yarn. The number of turns for the measured distance was recorded and the number of turns per centimeter was calculated. Only liners with single fiber content were measured for twist. Five measurements of each fiber type were taken and the averages were reported.

Moisture Content/Regain

To determine moisture content/regain of the glove liners, specimens were conditioned at standard atmosphere (20+/−2° C., 65+/−2% R.H.) and weighed to obtain initial mass. Specimens were then oven dried at a temperature of 105–110° C. until stable dry masses were obtained. The moisture content of the material is the mass of moisture present in a specimen expressed as a percentage of the initial mass of the specimen. The moisture regain of the material is the mass of moisture present in a specimen expressed as a percentage of the dry mass of the specimens. Two specimens were tested for each prototype glove liner.

Absorbency Capacity

To determine the absorbency capacity of the prototype liner materials, the Federal Standards 191 method 5500 for Dynamic Water Absorption was used. Since the specified 8×8 inch specimen could not be cut from a glove sample, the entire glove was used as a test specimen. The material/liquid ratio was kept consistent with the requirement stated in the standard test. Two samples of each prototype glove liner were tested. Each sample consisting of a pair of gloves was conditioned at standard atmosphere (20+/−2° C., 65+/−2% R.H.) and weighed to obtain the original weight. The four glove specimens were then added into a tumble jar with two liters of distilled water at 27+/−1° C. The jar was rotated at a rate of 55+/−2 revolutions per minute for 20 to 25 minutes. At the end of the required running time, each glove specimen was passed through a wringer, immediately placed smoothly between two sheets of blotting paper, and passed through the wringer again. After all specimens had been passed through the wringer, each sample (consisting of 2 gloves) was placed in a closed container and weighed to obtain the final weight. The percent of water absorption was calculated as the percent weight gain over the original sample weight and the average of two samples was reported.

Vertical Wicking

Vertical wicking test was performed in textile standard atmosphere of 65+/−2% R.H. and 20+/−2° C. in accordance with the DREO method (see footnote below Table 1). A graduated scale of 1 centimeter interval was marked on a 3×15 cm strip of the liner fabric using felt pen with water-soluble ink. As soon as one end of the vertically hanging specimen strip was immersed into a bath of water, the timing started. The time taken by water to reach each marked interval was recorded. Each test was run for a maximum of 15 minutes. The distance the water travelled as a function of time was recorded.

Drying Time

A method that measures how fast a material dried after wetting was developed by Quality Engineering Test Establishment of National Defence Canada since no standard test method was found through literature search (refer to Appendix A for more detailed description). Specimens of approximately 10 $cm^2$ were cut from the palm area of the glove. The edges of the specimens were sealed with liquid wax to prevent fraying. The actual area of the remaining specimen was measured after the samples were conditioned at standard textile atmosphere. Specimens were soaked in water containing a neutral non-ionic wetting agent for a minimum of one hour. Excess water was removed through a wringer and blotting papers. The specimens were then air-dried on a flat screen at standard textile atmosphere. The drying time was represented by the time period required for the wetted samples to obtain a constant weight at a minimum of 15 minutes interval. A drying rate was then calculated as minutes per square centimeter. Two specimens of each prototype liner were tested and the average was reported.

Sample Descriptions

Sixteen prototype glove liners were received for performance evaluation in accordance with the laboratory evaluation protocol. The glove liners were all jersey knit type but varied in fiber content and knit structures. Fibers selected for the prototype glove liners were cotton, viscose, polyester micro fiber (Coolmax (trademark)) (a polyester with tetra-channels for managing moisture) and acrylic. The amount of twist in cotton yarns (6 turns per centimetre) was slightly greater than both the viscose and polyester Coolmax which had 4.6–5.0 turns per centimeter. These slight differences were not expected to significantly affect absorption or wicking. The resulting fabric count for the first eight prototype glove liners were six wales and eight courses per centimeter. The commercially purchased glove liner (No. 42) had only a single spun yarn with 1.2 turns per centimeter. It is a half-finger design glove liner which had fabric count of six wales and eleven courses per centimeter. A description of these sixteen prototype glove liners is shown in Table 2.

Results and Discussion

Absorption and Drying Properties

An overall performance evaluation of the sixteen prototype glove liners is summarised in Table 3. Average values of mass, thickness, moisture regain, water absorption and drying time were listed for comparison.

The first three prototype glove liners were evaluated to determine the generic differences among liners made of a single fiber content of cotton, viscose or COOLMAX (polyester micro fiber). The 100% viscose liner (No. 18) had the highest moisture regain and water absorption but took the longest time to dry. It is also the heaviest among the three liners with 413.52 $g/m^2$. The cotton liner (No. 17) had 55% less absorption than the viscose liner and 14.5% less than the COOLMAX liner (No. 19). The COOLMAX liner took the shortest time to dry after wetting and the viscose liner had the longest drying time. The thickness of the liners were similar, with the viscose liner being slightly thinner probably due to the use of two plies yarn instead of three.

In order to obtain an optimum balance between water absorption and drying time, the combination of various types of fibers in glove liners and their effects on the overall glove properties were studied. Different knitting techniques were also utilized to maximize the absorbency property of a glove liner. When combining COOLMAX or viscose with cotton fibers (No. 20, 21), there were no significant differences in mass and thickness. However, the viscose/cotton liner (No. 21) had significantly higher water absorption and longer drying time than the COOLMAX/cotton combination. Liner No. 22 was made by the plating technique in which two yarns made of different fibers are consistently positioned with one yarn on the inside face of the liner and the other yarn on the outside face. It was evaluated to compare with the intimate blend structure of liner No. 20. No significant differences in properties were observed.

To improve the fit of the glove liner, Lycra yarns (a stretchable spandex filament yarn) were added to the cotton yarn. Liner No. 23 made of Coolmax/cotton/Lycra was compared with Liner No. 22 to determine if adding Lycra yarn affect the performance of the liners. The differences in absorption and drying properties between the two glove liners were negligible.

Liner No. 28 was knitted with the same type of yarns as liner No. 24 except it used only one cotton/LYCRA yarn instead of two. The total linear density for the yarn was reduced from 106 (Liner No. 24) to 62 (Liner No. 28). This change resulted in 36% reduction in mass. However, thickness and moisture regain remained similar. Absorption was slightly reduced and drying time was shortened by 1 minute/$cm^2$ for liner No. 28.

Liner No. 42 was commercially purchased with a half-finger design. It is made of 100% polyester as identified by microscopy, burning test and infrared spectroscopy. This liner was much lighter and thinner compared to all the prototype glove liners. However, it also had much lower water absorption capacity (half the amount than the other liners) and consequently dried very fast after wetting.

Because viscose fibers showed high absorption and COOLMAX fibers had fast drying time, glove liners made of these two fibers were evaluated. Liners No. 43 and No. 44 did not include any LYCRA fibers while liners No. 50 and No. 51 included LYCRA. Liners No. 43 and No. 44 were both made by the plating technique but varied in their yarn sizes (tex). Liner No. 44 that used higher density yarns (59 tex) was heavier, thicker and had higher water absorption and longer drying time than liner No. 43 made with lower yarn density (two yarns of 24 tex). Liners No. 50 and No. 51 were slightly thicker, more absorbent and had longer drying time than liner No. 43 and No. 44. This is probably due to the added LYCRA making the material more compact per unit area. Compared to COOLMAX/cotton liners (No. 20, No. 22, No. 23) and viscose/cotton liners (No. 21, No. 24, No. 28), the COOLMAX/viscose liners were superior choices in terms of higher absorption and shorter drying time.

Glove liners made of acrylic/LYCRA and viscose (No. 45, No. 47) showed a good combination of absorption and drying time. They had slightly lower absorption (77%) than the cotton/LYCRA and viscose liner No. 28 (79%), but dried 2.5 times faster.

The differences in properties between two knitting techniques (plated and speckled) were examined between liners No. 45 and No. 47, both made of Acrylic/LYCRA/viscose, and between liners No. 50 and No. 51 both made of COOLMAX/LYCRA/viscose. The plating technique was used to determine whether a wicking fiber such as polyester microfiber knitted on the inside of the liners could enhance moisture transfer to an outside fiber with greater absorption ability such as viscose and cotton. The speckled technique knits various yarns simultaneously throughout the material resulting in a mottled effect where different fibers could be randomly positioned on the inside or outside the surfaces of the material. There is no significant difference in the key properties between the liners made of the two different knit techniques. Slight differences can be observed within each fiber group for certain properties but there is no conclusive trend.

Wicking

The first nine glove liners (No. 17–No. 28) were tested for wicking as received and after washing. The glove liners tested for the dynamic water absorption were used for the wicking test after washing. The results of wicking ability comparing before and after washing for the nine glove liners are listed in Tables 4a and 4b. Liner No. 17 (100% cotton) did not wick within the 15 minutes test period for both as received and after washing samples. The cotton yarns used for this liner may not have been bleached. Both the viscose (No. 18) and the COOLMAX (No. 19) liners demonstrated good wicking ability. The viscose liner wicked 20% further in distance measured than the COOLMAX liners. The cotton/viscose liners (No. 21) had a better wicking ability than the cotton/COOLMAX (No. 20), which was due to the better wicking ability of the viscose fibers. There is not much difference in wicking ability for the viscose/cotton-LYCRA liners (No. 24 and No. 28), when replacing two yarns of cotton wrapped LYCRA with one. For all of the liners with viscose (No. 18, 21, 24, 28), the washed samples wicked faster in the course direction and slower in the wale direction than the unwashed samples. After washing, the wicking rates of the liners with COOLMAX yarns (No. 19, 22, 23) were much slower than the unwashed samples (not shown).

The commercially purchased liner (No. 42) had good wicking for the first 4 cm which took less than one minute. The wicking speed slowed down after 4 cm and almost stopped at 6–7 cm interval mark (not shown).

The results of wicking test showed that wicking in the wale direction was slightly better than in the course direction for liners No. 43, No. 44, No. 45 and No. 47 (Table 5). However, the wicking patterns of the two directions were similar. The viscose/Acrylic/LYCRA liners (No. 45 and No. 47) had identical wicking ability as the COOLMAX/viscose liners (No. 43 and No. 44). There is little difference in wicking patterns when using one high density COOLMAX yarn (No. 43) instead of two low density COOLMAX yarns (No. 44). Although liners No. 45 and No. 47 were made by different knitting techniques, plated and speckled respectively, their wicking abilities were similar.

Glove liners No. 50 and No. 51 were tested using the revised wicking test method. Ten specimens were tested in the wale direction for ten minutes and final wicking heights and mass gains were recorded. The percent water absorption were calculated based on the original specimen mass (Table 6). Both glove liners were made of viscose/COOLMAX/LYCRA, but liner No. 50 used the plating knit technique while No. 51 used the speckle. The wicking patterns were very similar.

Industrial Applications

Variations of viscose and COOLMAX/LYCRA yarns described in this invention were used in industrial and military applications. Glove liners made of materials of this invention provides both moisture management and comfort. For example, when wearing glove liners made of materials in accordance with this invention inside conventional NBC contaminants protective gloves (such as NSN 8415-21-921-2163) provide wearer with hand protection during operations where exposure to nuclear, biological and chemical hazards may be present.

Specifications of the viscose and combined COOLMAX/LYCRA yarns for manufacturing military glove liners using the materials of the present invention are illustrated as follows:

| Typical "Small Size" Glove | | |
|---|---|---|
| Primary Feeder: | | |
| YN #1: 24/1 Viscose | No. of Ends: 1 | WGT/GR: 6.0/±1.0 |
| Plaiting Feeder: | | |
| YN #1: 24/1COOLMAX | No. of Ends: 1 | WGT/GR: 6.0/±1.0 |
| YN #2: 100% LYCRA | No. of Ends: 1 | WGT/GR: 0.8/±0.1 |
| Typical "Medium Size" Glove | | |
| Primary Feeder: | | |
| YN #1: 24/1 Viscose | No. of Ends: 1 | WGT/GR: 7.0/±1.0 |

-continued

| | | |
|---|---|---|
| Plaiting Feeder: | | |
| YN #1: 24/1COOLMAX | No. of Ends: 1 | WGT/GR: 6.0/±1.0 |
| YN #2: 100% LYCRA | No. of Ends: 1 | WGT/GR: 0.8/±0.1 |
| Typical "Large Size" Glove | | |
| Primary Feeder: | | |
| YN #1: 24/1 Viscose | No. of Ends: 1 | WGT/GR: 9.0/±1.0 |
| Plaiting Feeder: | | |
| YN #1: 24/1COOLMAX | No. of Ends: 1 | WGT/GR: 8.0/±1.0 |
| YN #2: 100% LYCRA | No. of Ends: 1 | WGT/GR: 0.8/±0.1 |

Conclusions

The specific fiber type, yarn combination and glove design proposed resulted from an extensive investigation of the effects of yarns (tex and fiber content) on dynamic absorbency, wicking and drying ability when knit into glove liners.

As can be seen from the foregoing results and discussions, glove liners knit from a combination of COOLMAX/LYCRA yarns with total density in the rangeof 26 to 83 yarn tex and viscose yarn with density in the range of 25 to 59 yarn tex (see Table 2, Glove Nos. 50 and 51) are suitable for chemical protective gloves according to this invention. Preferably, glove liners knit from a combination of COOLMAX/LYCRA with 20 yarn tex density and viscose yarn with 25 yarn tex density yield the highest overall results. Other yarns made from fibers having similar properties and tex size can also be used. The combined tex values provide a glove that meets the thickness required for a liner used in polymer gloves and were specifically designed to meet design criteria for polymer gloves described in Canadian Patent Application 2,346,633 and U.S. patent application Ser. No. 09/850,198. The LYCRA included in the COOLMAX yarn offers a better fit and reduces any sagging which is common in knit liners. The COOLMAX/LYCRA yarns act as a carrier for the sweat and the viscose yarn acts as an absorber to keep the sweat away from the hand. The fabric count for gloves used in the technical evaluation varied by size to produce a final product count of 7±2 wales/cm and 11±2courses/cm. Preferably, the fabric count equals to 7 wales/cm and 10 courses/cm.

Both speckled knitting technique, in which the two yarns are knit simultaneously whereby the yarns may be exposed to the inner or outer surface of the glove and the plating technique, which controls the position of the two yarns on the inner and outer surface, produce equally satisfactory results.

The glove liner of the present invention represents a functional design that conforms to the hand for quick pick up of moisture and is constructed from combination of fibers to provide effective management of sweat and drying ability. Such glove liner material reduces interference with gloved hand dexterity and minimizes bulk in impermeable gloves. The liner can be used with any other impermeable or protective gloves requiring a wicking layer that provides optimum fit and function within a glove system. The liner can also be used independently in other applications where form fitting liners are required.

It is to be understood that Table 2 only shows samples of prototype glove liners studied in this invention. Accordingly, the embodiments and variations shown and described herein are merely illustrative of the principles of this invention and that various modifications may be implemented by those skilled in the art without departing from the scope and spirit of the invention.

TABLE 1

LABORATORY EVALUATION PROTOCOL FOR CW GLOVE LINERS

| PROPERTY | TEST METHOD | UNITS REPORTED |
|---|---|---|
| Mass | CAN/CGSB-4.2 No. 5.1-M90① | $g/m^2$ |
| Glove Weight | CAN/CGSB-4.2 No. 2-M88 | g/glove, conditioned at 20+/−2° C., 65+/−2% R.H. |
| Thickness | CAN/CGSB-4.2 No. 37-M87 | mm, 5 readings at 1.0 kPa pressure |
| Fabric Count | CAN/CGSB-4.2 No. 7-M88 | wales/cm, courses/cm |
| Yarn Twist | CAN/CGSB-4.2 No. 8.1-M89 | turns/cm |
| Moisture Regain | CAN/CGSB-4.2 No. 3-M88 | % moisture present in a dry specimen |
| Dynamic Water Absorption | Fed. Std. 191 Method 5500 | % water absorbed over the sample weight |
| Vertical Wicking | DREO Method② | Distance in cm of water travelled for a given time |
| Drying Time | QETE Method③ | $min/cm^2$ |

①CAN/CGSB denotes Canadian General Standards Board
②DREO denotes Defence Research Establishment Ottawa
③QETE denotes Quality Engineering Test Establishment, National Defence Canada (See Appendix A for full description)

TABLE 2

SAMPLE DESCRIPTION OF PROTOTYPE CD GLOVE LINERS

| Glove | Fiber | Threads | | Yarn | Fabric Count | |
|---|---|---|---|---|---|---|
| No. | Content | Per Yarn | Yarn Tex | Structure | Wales/cm | Courses/cm |
| No. 17 | 100% Cotton | 3 | 47/34/24 | grouped | 6 | 8 |
| No. 18 | 100% Viscose | 2 | 56/53 | grouped | 6 | 8 |
| No. 19 | 100% COOLMAX | 2 | 48/55/24 | grouped | 6 | 8 |

TABLE 2-continued

SAMPLE DESCRIPTION OF PROTOTYPE CD GLOVE LINERS

| Glove No. | Fiber Content | Threads Per Yarn | Yarn Tex | Yarn Structure | Fabric Count Wales/cm | Fabric Count Courses/cm |
|---|---|---|---|---|---|---|
| No. 20 | COOLMAX Cotton | 1<br>2 | 48<br>24/27 | Blended | 6 | 8 |
| No. 21 | Viscose<br>Cotton | 1<br>2 | 56<br>24/27 | Plated, in out | 6 | 8 |
| No. 22 | COOLMAX<br>Cotton | 1<br>2 | 58<br>22/26 | Plated, in out | 6 | 8 |
| No. 23 | COOLMAX<br>Cotton/LYCRA* | 1<br>2 | 60<br>22/19 | Plated, in out | 6 | 8 |
| No. 24 | Viscose<br>Cotton/LYCRA* | 1<br>2 | 59<br>24/23 | Blended | 6 | 8 |
| No. 28 | Viscose<br>Cotton/LYCRA* | 1<br>1 | 40<br>22 | Blended | 6 | 8 |
| No. 42 | 100% Polyester | 1 | 8 | 1 spun yarn | 6 | 11 |
| No. 43 | COOLMAX<br>Viscose | 2<br>1 | 24/24<br>39 | Plated, in out | 7 | 8 |
| No. 44 | COOLMAX<br>Viscose | 1<br>1 | 59<br>39 | Plated, in out | 6 | 8 |
| No. 45 | Acrylic/LYCRA<br>Viscose | 1<br>1 | 18<br>37 | Plated, in out | 7 | 11 |
| No. 47 | Acrylic/LYCRA<br>Viscose | 1<br>1 | 20<br>43 | Speckled | 7 | 11 |
| No. 50 | COOLMAX/LYCRA<br>Viscose | 1<br>1 | 20<br>25 | Plated, in out | 7 | 10 |
| No. 51 | COOLMAX/LYCRA<br>Viscose | 1<br>1 | 20<br>25 | Speckled | 7 | 10 |

*Cotton wrapped LYCRA was used in all cotton/LYCRA designations

TABLE 3

PERFORMANCE COMPARISON OF PROTOTYPE CD GLOVE LINERS

| Glove No. | Fiber Content | Mass ($g/m^2$) | Thickness (mm) | Moisture Regain (%) | % Water Absorbed | Drying Time ($min/cm^2$) |
|---|---|---|---|---|---|---|
| No. 17 | 100% Cotton | 345.21 | 1.697 | 6.44 | 48.11 | 3.38 |
| No. 18 | 100% Viscose | 413.52 | 1.580 | 12.54 | 106.16 | 4.92 |
| No. 19 | 100% COOLMAX | 375.14 | 1.712 | 0.41 | 55.07 | 2.36 |
| No. 20 | Blend, 54% COOLMAX 46% Cotton | 369.04 | 1.666 | 3.10 | 55.95 | 3.34 |
| No. 21 | Plated, Viscose in Cotton out | 370.39 | 1.773 | 9.65 | 85.98 | 5.31 |
| No. 22 | Plated, COOLMAX in Cotton out | 356.47 | 1.722 | 3.04 | 51.11 | 3.52 |
| No. 23 | Plated, COOLMAX in Cotton/LYCRA out | 379.99 | 1.768 | 2.85 | 46.85 | 3.11 |
| No. 24 | Blend, Viscose Cotton/LYCRA | 399.65 | 1.768 | 10.19 | 83.23 | 6.70 |
| No. 28 | Blend, Viscose Cotton/LYCRA | 253.75 | 1.803 | 10.81 | 79.12 | 5.74 |
| No. 42 | 100% Polyester | 101.41 | 1.107 | 0.51 | 34.95 | 0.20 |
| No. 43 | Plated, COOLMAX in Viscose out | 314.86 | 1.321 | 7.03 | 64.54 | 1.82 |
| No. 44 | Plated, COOLMAX in Viscose out | 324.17 | 1.397 | 6.71 | 66.13 | 1.94 |
| No. 45 | Plated, Acrylic/LYCRA in Viscose out | 286.58 | 1.427 | 10.41 | 77.44 | 1.81 |
| No. 47 | Speckled, Acylic/LYCRA Viscose | 294.16 | 1.646 | 10.44 | 76.73 | 1.99 |
| No. 50 | Plated COOLMAX/LYCRA in Viscose out | 244.83 | 1.60 | 7.76 | 67.26 | 2.31 |
| No. 51 | Speckled COOLMAX/LYCRA Viscose | 244.21 | 1.63 | 7.67 | 71.67 | 2.28 |

TABLE 4a

WICKING ABILITY OF GLOVE LINERS NO. 17–28: UNWASHED

| | Average Time in Seconds for Wicking Distances | | | | | | | | | |
|---|---|---|---|---|---|---|---|---|---|---|
| Sample No. 1 | 1 cm | 2 cm | 3 cm | 4 cm | 5 cm | 6 cm | 7 cm | 8 cm | 9 cm | 10 cm |
| 17-wale | no wick | | | | | no wick | | | | |
| course | no wick | | | | | no wick | | | | |
| 18-wale | 3.69 | 16.60 | 42.44 | 91.01 | 177.90 | 297.13 | 442.14 | 680.69 | | |
| Std Dev | 2.28 | 4.71 | 10.58 | 8.20 | 17.98 | 22.58 | 26.59 | 28.15 | | |
| 18-course | 1.57 | 10.32 | 31.23 | 73.72 | 144.85 | 275.25 | 448.38 | 698.11 | | |
| Std Dev | 0.65 | 2.97 | 5.91 | 12.74 | 18.52 | 32.03 | 37.97 | 51.63 | | |
| 19-wale | 0.25 | 92.33 | 202.00 | 465.33 | 604.67 | | | | | |
| Std Dev | 0.14 | 48.34 | 91.03 | 272.36 | 174.36 | | | | | |
| 19-course | 0.35 | 134.67 | 308.00 | 552.67 | 769.67 | | | | | |
| Std Dev | 0.13 | 50.20 | 135.50 | 223.76 | 132.55 | | | | | |
| 20-wale | no wick | | | | | no wick | | | | |
| Std Dev | | | | | | | | | | |
| 20-course | no wick | | | | | no wick | | | | |
| Std Dev | | | | | | | | | | |
| 21-wale | 12.03 | 18.31 | 131.67 | 300.33 | 493.67 | 814.67 | | | | |
| Std Dev | 16.94 | 30.91 | 29.69 | 8.96 | 13.87 | 34.49 | | | | |
| 21-course | 0.26 | 80.00 | 159.33 | 297.67 | 485.00 | 741.33 | | | | |
| Std Dev | 0.07 | 15.39 | 22.19 | 40.15 | 24.56 | 30.55 | | | | |
| 22-wale | 54.38 | 174.00 | 394.00 | 675.67 | | | | | | |
| Std Dev | 50.13 | 61.73 | 128.01 | 144.69 | | | | | | |
| 22-course | 0.19 | 23.37 | 127.33 | 239.33 | 396.33 | 591.33 | | | | |
| Std Dev | 0.03 | 39.51 | 6.43 | 29.14 | 58.45 | 44.46 | | | | |
| 23-wale | 106.00 | 279.33 | 523.67 | 621.00 | | | | | | |
| Std Dev | 22.61 | 85.52 | 196.23 | N/A* | | | | | | |
| 23-course | 41.61 | 278.33 | 315.67 | 542.00 | 611.00 | 788.00 | | | | |
| Std Dev | 71.35 | 302.87 | 182.46 | 213.33 | 66.47 | N/A* | | | | |
| 24-wale | 0.11 | 0.34 | 82.00 | 143.33 | 224.33 | 340.67 | 479.33 | 626.33 | | |
| Std Dev | 0.05 | 0.04 | 5.57 | 8.62 | 1.15 | 18.23 | 42.44 | 62.58 | | |
| 24-course | 0.12 | 0.37 | 87.00 | 163.67 | 254.67 | 376.67 | 533.33 | 750.67 | 869.00 | |
| Std Dev | 0.03 | 0.12 | 15.62 | 16.20 | 33.32 | 48.01 | 79.07 | 102.16 | N/A* | |
| 28-wale | 0.11 | 0.32 | 72.33 | 129.33 | 210.67 | 323.67 | 461.33 | 641.33 | 819.50 | |
| Std Dev | 0.03 | 0.07 | 12.66 | 20.50 | 42.12 | 37.63 | 52.00 | 52.73 | 19.09 | |
| 28-course | 0.07 | 0.23 | 45.77 | 116.67 | 222.33 | 355.00 | 542.00 | 772.33 | | |
| Std Dev | 0.04 | 0.11 | 40.07 | 29.50 | 27.43 | 40.11 | 56.47 | 84.13 | | |

*Only one of the three specimens wicked.

TABLE 4b

WICKING ABILITY OF GLOVE LINERS NO. 17–28: WASHED

| | Average Time in Seconds for Wicking Distances | | | | | | | | | |
|---|---|---|---|---|---|---|---|---|---|---|
| Sample No. 1 | 1 cm | 2 cm | 3 cm | 4 cm | 5 cm | 6 cm | 7 cm | 8 cm | 9 cm | 10 cm |
| 17-wale | no wick | | | | | no wick | | | | |
| course | no wick | | | | | no wick | | | | |
| 18-wale | 6.65 | 15.93 | 43.96 | 103.13 | 216.35 | 400.99 | 653.96 | | | |
| Std Dev | 0.71 | 5.55 | 5.30 | 11.19 | 21.81 | 18.07 | 21.47 | | | |
| 18-course | 3.63 | 15.46 | 39.37 | 76.36 | 143.54 | 252.07 | 433.41 | 719.52 | | |
| Std Dev | 1.40 | 3.83 | 11.51 | 21.78 | 35.45 | 55.45 | 76.71 | 88.87 | | |
| 19-wale | 338.25 | | | | | | | | | |
| Std Dev | N/A* | | | | | | | | | |
| 19-course | 141.81 | 270.13 | 531.77 | 763.58 | | | | | | |
| Std Dev | 28.11 | 71.92 | 98.20 | | | | | | | |
| 20-wale | 755.25 | | | | | | | | | |
| Std Dev | N/A* | | | | | | | | | |
| 20-course | 280.24 | 572.53 | 839.03 | | | | | | | |
| Std Dev | 142.16 | 125.59 | 16.75 | | | | | | | |
| 21-wale | 12.27 | 91.59 | 261.57 | 515.81 | 915.41 | | | | | |
| Std Dev | 7.18 | 19.80 | 42.54 | 26.68 | 12.09 | | | | | |
| 21-course | 4.37 | 18.06 | 56.33 | 116.52 | 211.96 | 349.86 | 534.33 | 763.31 | | |
| Std Dev | 0.72 | 4.02 | 11.16 | 15.98 | 22.52 | 31.86 | 23.68 | 15.15 | | |
| 22-wale | no wick | | | | | | | | | |
| Std Dev | | | | | | | | | | |
| 22-course | 100.23 | 341.82 | 774.53 | 898.00 | | | | | | |
| Std Dev | 50.30 | 113.11 | 17.40 | N/A* | | | | | | |
| 23-wale | no wick | | | | | | | | | |
| Std Dev | | | | | | | | | | |
| 23-course | 509.09 | 915.08 | | | | | | | | |
| Std Dev | 241.54 | | | | | | | | | |

TABLE 4b-continued

WICKING ABILITY OF GLOVE LINERS NO. 17–28: WASHED

| Sample No. 1 | Average Time in Seconds for Wicking Distances | | | | | | | | | |
|---|---|---|---|---|---|---|---|---|---|---|
| | 1 cm | 2 cm | 3 cm | 4 cm | 5 cm | 6 cm | 7 cm | 8 cm | 9 cm | 10 cm |
| 24-wale | 12.63 | 47.34 | 107.15 | 193.67 | 312.14 | 459.29 | 640.66 | 868.25 | | |
| Std Dev | 6.60 | 12.74 | 21.61 | 28.97 | 48.20 | 64.19 | 85.81 | 107.58 | | |
| 24-course | 4.07 | 19.88 | 48.73 | 99.65 | 169.44 | 283.80 | 421.78 | 602.31 | 810.26 | |
| Std Dev | 1.23 | 2.28 | 3.12 | 9.51 | 10.32 | 17.66 | 30.23 | 37.51 | 39.17 | |
| 28-wale | 6.88 | 35.08 | 80.79 | 154.36 | 262.23 | 397.11 | 574.32 | 801.06 | | |
| Std Dev | 2.14 | 14.18 | 22.19 | 37.12 | 50.32 | 65.57 | 87.85 | 102.93 | | |
| 28-course | 2.96 | 13.60 | 31.48 | 70.70 | 133.96 | 215.01 | 336.91 | 491.10 | 695.73 | 855.68 |
| Std Dev | 1.49 | 4.90 | 5.49 | 5.09 | 3.34 | 14.27 | 35.97 | 43.53 | 64.82 | N/A* |

*Only one of the three specimens wicked.

TABLE 5

WICKING ABILITY OF GLOVE LINERS NO. 42 to NO. 47

| Sample No. | Average Time in Seconds for Wicking Distances | | | | | | | | | | |
|---|---|---|---|---|---|---|---|---|---|---|---|
| | 1 cm | 2 cm | 3 cm | 4 cm | 5 cm | 6 cm | 7 cm | 8 cm | 9 cm | 10 cm | 11 cm |
| 42-wale | 1.31 | 4.73 | 11.73 | 20.44 | 51.26 | 104.33 | 405.31 | 146.27 | ** | | |
| Std Dev | 0.52 | 0.19 | 0.71 | 3.53 | 13.73 | 58.50 | 420.44 | N/A* | | | |
| 42-course | 1.29 | 5.14 | 12.57 | 38.38 | 220.46 | 264.62 | | | | | |
| Std Dev | 0.50 | 2.05 | 4.42 | 19.42 | 213.43 | N/A* | | | | | |
| 43-wale | 2.65 | 6.62 | 15.49 | 42.43 | 93.97 | 185.28 | 297.12 | 462.84 | 678.32 | 728.3 | |
| Std Dev | 0.64 | 0.55 | 1.75 | 9.27 | 20.85 | 53.04 | 92.55 | 129.76 | 158.51 | N/A* | |
| 43-course | 3.23 | 8.65 | 28.53 | 67.31 | 143.22 | 278.19 | 483.00 | 778.76 | | | |
| Std Dev | 1.31 | 1.91 | 5.11 | 4.45 | 27.65 | 25.05 | 19.83 | 38.09 | | | |
| 44-wale | 1.71 | 7.85 | 18.25 | 40.82 | 71.75 | 121.16 | 189.24 | 265.39 | 383.53 | 584.50 | 716.5 |
| Std Dev | 0.39 | 1.68 | 3.27 | 7.71 | 6.86 | 1.98 | 13.90 | 18.90 | 18.92 | 99.22 | 15.15 |
| 44-course | 2.33 | 8.75 | 21.85 | 49.12 | 90.46 | 161.52 | 276.06 | 433.40 | 657.63 | 877.90 | |
| Std Dev | 0.12 | 1.59 | 2.86 | 11.16 | 10.72 | 13.73 | 19.80 | 33.22 | 41.57 | N/A* | |
| 45-wale | 1.84 | 6.06 | 15.66 | 32.74 | 62.26 | 120.56 | 189.40 | 311.24 | 499.23 | 634.80 | |
| Std Dev | 0.23 | 1.93 | 7.19 | 13.78 | 26.71 | 49.17 | 70.84 | 91.85 | 139.29 | 35.62 | |
| 45-course | 1.98 | 7.02 | 19.50 | 43.22 | 84.87 | 160.48 | 274.57 | 445.09 | 698.12 | | |
| Std Dev | 0.83 | 2.55 | 3.76 | 9.18 | 17.38 | 28.93 | 39.75 | 69.14 | 96.62 | | |
| 47-wale | 2.28 | 6.24 | 14.81 | 29.75 | 59.82 | 112.99 | 198.01 | 472.58 | 691.10 | 827.20 | |
| Std Dev | 0.75 | 1.30 | 2.93 | 7.52 | 16.88 | 28.36 | 46.19 | 69.96 | 110.24 | 112.60 | |
| 47-course | 2.57 | 8.50 | 21.64 | 45.38 | 94.78 | 178.10 | 305.11 | 505.63 | 795.19 | | |
| Std Dev | 0.45 | 0.50 | 3.01 | 6.50 | 14.29 | 22.09 | 39.44 | 57.87 | 51.88 | | |

*Only one of the three specimens wicked.
**The test run out of the length of the specimen.

TABLE 6

WICKING ABILITY OF GLOVE LINERS NO. 54 AND NO. 51

| Sample No. | Initial mass (g) | Average Time in Seconds for Wicking Distances in Wales Direction | | | | | | | | | | Final height | Final mass | % mass gained |
|---|---|---|---|---|---|---|---|---|---|---|---|---|---|---|
| | | 1 cm | 2 cm | 3 cm | 4 cm | 5 cm | 6 cm | 7 cm | 8 cm | 9 cm | 10 cm | | | |
| No. 50 | | | | | | | | | | | | | | |
| Average | 1.19 | 2.06 | 6.15 | 12.44 | 23.64 | 42.38 | 70.26 | 138.88 | 229.23 | 365.84 | 500.27 | 10.08 | 4.01 | 235.80 |
| Std Dev | 0.03 | 0.64 | 1.23 | 1.48 | 2.83 | 106.42 | 25.51 | 12.93 | 25.27 | 37.39 | 170.11 | 0.16 | 0.16 | 11.87 |
| No. 51 | | | | | | | | | | | | | | |
| Average | 1.17 | 2.07 | 5.90 | 11.35 | 21.87 | 40.67 | 76.36 | 135.66 | 223.30 | 358.89 | 493.98 | 10.12 | 3.93 | 234.61 |
| Std Dev | 0.05 | 1.03 | 1.23 | 1.65 | 3.85 | 7.12 | 12.62 | 20.79 | 25.36 | 36.92 | 177.60 | 0.20 | 0.16 | 6.97 |

Note: The tests were run for 10 minutes in wales direction only.

Appendix "A"

Test Method for Drying Time of Wetted Textile Material Developed by Quality Engineering Test Establishment of National Defence Canada 1. Purpose and Scope 1.1 This method determines the drying time of a wetted material, such as glove liner.

2. Principle 2.1 Specimens of fabric are soaked in water containing a wetting agent. After excess water is removed, the specimens are air-dried on a flat surface under standard textile atmosphere. The drying time of the wetted material is measured by the time period needed for the wetted material to obtain constant weight.

2. Applicable Publications 3.1 The following publications are applicable to this method.

3.1.1. Canadian General Standards Board (CGSB) CAN/CGSB-4.2-Textile Test Methods:

No.1-M-Precision and Accuracy of Measurement

No.2-M-Conditioning Textile Materials for Testing

No.3-M-Determination of Moisture in Textiles

No.4-M-Dimensional Change in Wetting 3.1.2 FED Test Method STD. 191A

Method 5500-1978-Water Resistance of Cloth: Dynamic Absorption Method

3. Apparatus and Reagents 4.1 Container: at least 380×380×25 mm deep.

4.2 Neutral nonionic wetting agent.

4.3 Wringer: equipped with smooth rubber squeeze rolls 54 to 64 mm in diameter and 279 to 406 mm in length. The rubber rolls shall have a Shore durometer hardness of 70 to 80 (A scale). A dead weight is attached to the top roller to apply a uniform load to the specimen. The total load of the roller and the weight attached to it shall be 60 pounds (27.2kg). The rolls shall be power driven at a speed of 25 mm per second.

4.4 Balance: capable of determining the mass of the specimen, sensitive to 0.001 g.

4.5 Blotting paper.

4. Test Specimens 5.1 Cut two specimens of approximately 100 mm5 with different warp and weft yarns (or different wales and courses) from an area of the fabric that is free from wrinkles and creases.

5.2 Seal the edges of the specimens by dipping the edge into hot wax bath and letting it air-dry to prevent the specimen from fraying. Re-measure the actual specimen area excluding the waxed edges.

5.3 Condition the specimen in accordance with CAN/CGSB-4.2 No.2-M and place them on a flat surface.

5. Procedure 6.1 Each conditioned specimen shall be weighed to obtain initial mass.

6.2 Immerse the specimens for at least 1 hour in water at 25 to 30 C. to which has been added 0.5 g/L of a neutral nonionic wetting agent to facilitate rapid wetting-out of the fabric.

6.3 At the end of the required wetting time, each specimen shall be run through the wringer with one edge parallel to the length of the rollers.

6.4 The specimen shall immediately be placed smoothly between two sheets of blotting paper. The specimen sandwiched between the blotting papers shall be passed through the rollers of the wringer again. The specimen shall be left between the two blotters until the other specimen has completed the same procedure.

6.5 The two specimens together with the blotters shall be moved to conditioning room. Remove the specimens from the blotters and place them in a flat meshed surface which allows air circulating.

6.6 Start timing. Record the starting time when the specimens are removed from the blotters. Weigh each specimen every 2 hour to 1 hour to record the time and the mass of the specimen. When the specimens are close to dry, weigh the specimens every 15 to 30 minutes.

6.7 The constant mass of the specimen is achieved when at least 2 to 3 successive determinations differ by less than +0.005 g at intervals of not less than 15 minutes. The drying time is determined by calculating the difference between the starting time and the time when first constant mass of the specimen is achieved.

6. Report 7.1 The initial mass of each specimen.

7.2 The drying time of each specimen and the calculated drying time per square meter.

7.3 The averaged drying time per square meter.

I claim:

1. A glove liner which comprises:

(i) viscose yarn with density ranging between 25–59 yarn tex; and (ii) combination of polyester and acrylic yarn with combined density ranging between 26–83 yarn tex with fabric count ranging between 7±2 wales/cm and between 11±2 courses/cm.

2. A glove liner of claim 1, wherein said polyester has tetra-channels which manage moisture and said acrylic is a stretchable spandex filament yarn.

3. A glove liner of claim 1, wherein said liner is knitted by plated technique.

4. A glove liner of claim 1, wherein said liner is knitted by speckled technique.

5. A glove liner which comprises:

(i) viscose yarn with density of 25 yarn tex; and (ii) combination of polyester and acrylic yarn with combined density of 20 yarn tex with fabric count equal to 7 wales/cm and 10 courses/cm.

* * * * *